US007922506B1

(12) United States Patent
Harlan et al.

(10) Patent No.: US 7,922,506 B1
(45) Date of Patent: Apr. 12, 2011

(54) CARD EDGE CONNECTOR

(75) Inventors: Tod M. Harlan, Mechanicsburg, PA (US); Richard Lee Malehorn, York, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/650,578

(22) Filed: Dec. 31, 2009

(51) Int. Cl.
*H01R 13/62* (2006.01)

(52) U.S. Cl. ..... 439/160

(58) Field of Classification Search ..... 439/160, 439/157, 153, 328, 327, 326
See application file for complete search history.

(56) References Cited

U.S. PATENT DOCUMENTS 5,364,282 A 11/1994 Tondreault
5,634,803 A 6/1997 Cheng et al.
6,074,231 A * 6/2000 Ju ..... 439/327
6,159,031 A * 12/2000 Llapitan et al. ..... 439/326
6,319,027 B1 * 11/2001 Pickles et al. ..... 439/157
6,702,598 B1 * 3/2004 Lo ..... 439/157
6,981,886 B1 * 1/2006 Co et al. ..... 439/160
7,029,307 B1 4/2006 Ling et al.
7,083,448 B2 * 8/2006 Tanigawa ..... 439/160
7,371,097 B1 * 5/2008 Pennypacker et al. ..... 439/327
7,484,978 B1 2/2009 Gao

* cited by examiner

*Primary Examiner* — Neil Abrams
*Assistant Examiner* — Phuongchi T Nguyen
(74) *Attorney, Agent, or Firm* — Wei Te Chung; Andrew C. Cheng; Ming Chieh Chang

(57) ABSTRACT

A card edge connector for receiving a module and includes an insulative housing having a mounting face, a pair of side walls with a central slot formed therebetween, a tower portion extending upwardly from the side wall; a number of contacts mounted to the housing and each defining a retaining portion to fix with the housing, a deflectable contacting arm extending upwardly from the retaining portion and a soldering portion extending downwardly from the retaining portion and projecting beyond the mounting face; and an ejector rotatably mounted on the tower portion of the housing. The ejector includes a base portion, an ejecting portion extending inwardly from the base portion and protruding into the central slot to eject the memory module from the central slot and a cam lobe extending inwardly from the base portion to drive the module down, the cam lobe is located above the ejecting portion.

20 Claims, 6 Drawing Sheets

CARD EDGE CONNECTOR

BACKGROUND OF THE INVENTION

1. Field of the Invention

The present invention generally relates to a card edge connector for receiving a module and more particularly to a card edge connector including means to reduce insertion force of the module.

2. Description of Related Art

A card edge connector (memory socket) is used to hold a memory module such as a DDR 3 module and to electrically couple such module to a mother printed circuit board on which the card edge connector is mounted. The card edge connector generally includes an elongated insulative housing having a central slot for receiving the module, a plurality of metal contacts extending into the slot for electrically connecting with the module, a pair of ejectors rotatablely attached to two opposite ends of the housing. The ejector is adapted to latch with a locking notch on a side edge of the module in a working state and to bias against a bottom edge of the module to eject the module out of the slot in an extracting state.

With the high speed development of the memory module, more and more golden pads are added to the module, correspondingly, the number of contacts of the card edge connector is increased. In the process of inserting the module into the slot of card edge connector, the module has to overcome the resistance force of the contacts to deflect the contacts outwardly. The increase in the number of contacts would raise the resistance force considerably, thereby making it more difficult to insert the module into the card edge connector.

SUMMARY OF THE INVENTION

According to one aspect of the present invention, a card edge connector for receiving a module, comprising: an insulative housing having a mounting face, a pair of side walls with a central slot formed therebetween, a tower portion extending upwardly from the side wall; a plurality of contacts mounted to the housing and each defining a retaining portion to fix with the housing, a deflectable contacting arm extending upwardly from the retaining portion and a soldering portion extending downwardly from the retaining portion and projecting beyond the mounting face; an ejector rotatably mounted on the tower portion of the housing, the ejector including a base portion, an ejecting portion extending inwardly from the base portion and protruding into the central slot to eject the memory module from the central slot and a cam lobe extending inwardly from the base portion to drive the module down, the cam lobe is located above the ejecting portion.

According to another aspect of the present invention, a card edge connector for receiving a module which including an upper notch and a lower notch on a side edge thereof, comprising: an insulative housing having a mounting face, a pair of side walls with a central slot formed therebetween; a plurality of contacts mounted to the housing and each defining a retaining portion to fix with the housing, a deflectable contacting arm extending upwardly from the retaining portion and a soldering portion extending downwardly from the retaining portion and projecting beyond the mounting face; an ejector rotatably mounted on the housing, the ejector including a base portion, a locking portion extending inwardly to lock with the upper notch, an ejecting portion extending inwardly from the base portion and protruding into the central slot to eject the memory module from the central slot and a cam lobe extending inwardly from the base portion to drive the module down and to lock with the lower notch, the cam lobe is located above the ejecting portion.

Other objects, advantages and novel features of the present invention will become more apparent from the following detailed description of the present embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
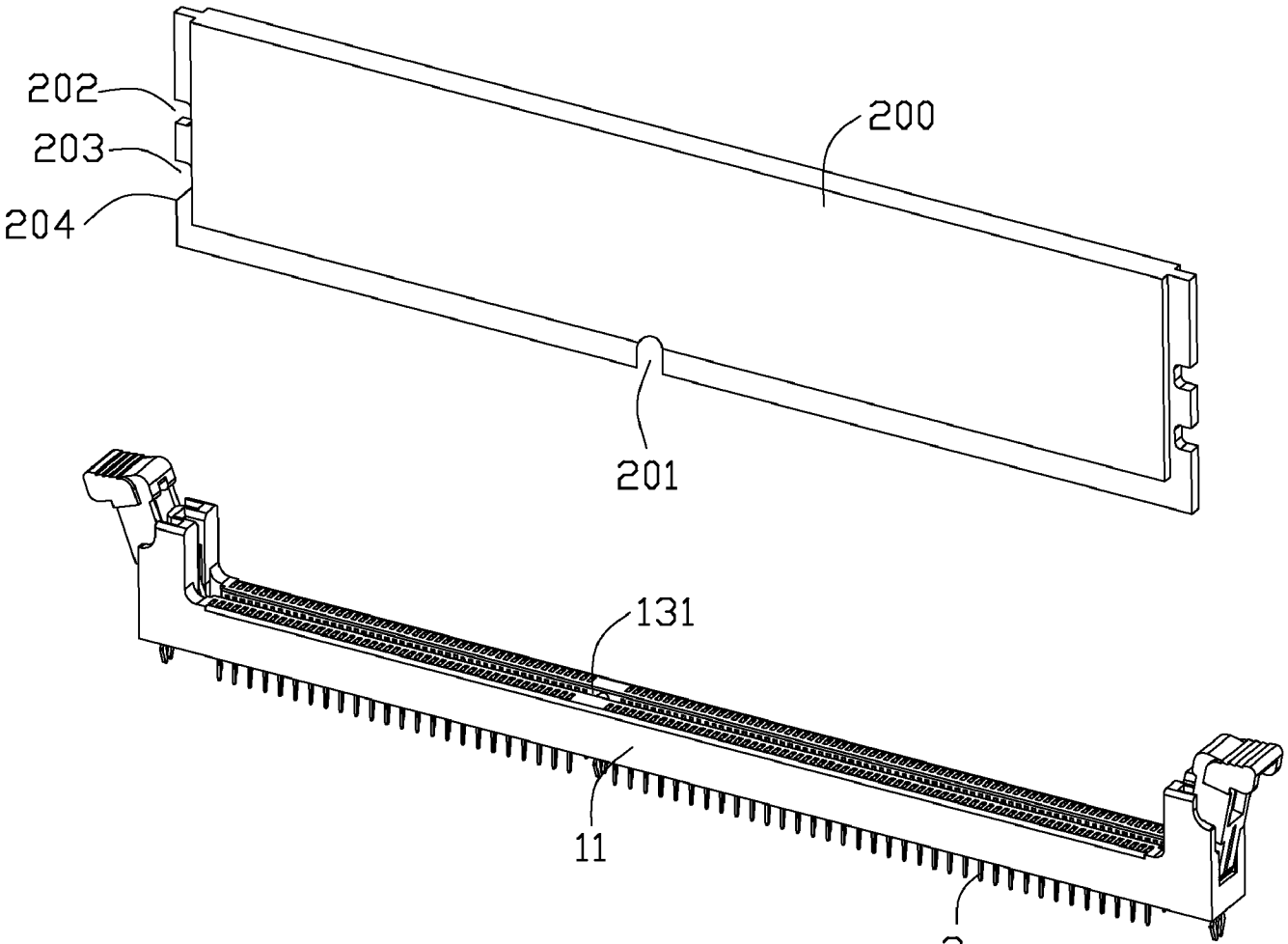
FIG. 1 is a perspective view of a card edge connector and a mating module according to a preferred embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
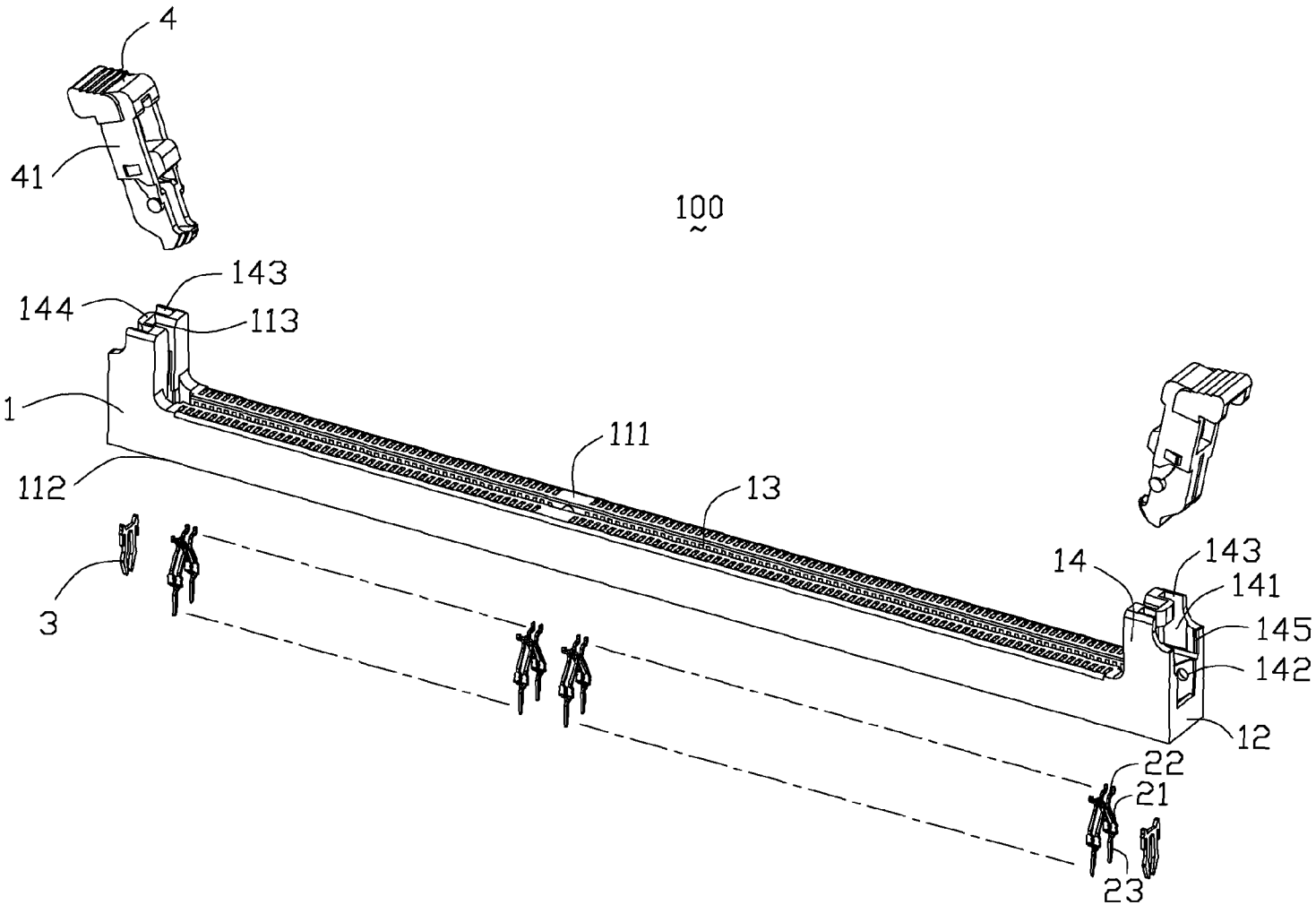
FIG. 2 is an exploded perspective view of the electrical connector shown in FIG. 1.

Referring to FIGS. 1-2, a card edge connector 100 according to the present invention is preferably a memory socket to be mounted on a mother printed circuit board, comprises an elongated housing 1 having a pair of longitudinal side walls 11 extending along a lengthwise direction thereof, a pair of end walls 12 extending from opposite ends of the side walls 11 to connect the side walls 11, an elongated central slot 13 formed therebetween for receiving a corresponding memory module 200 therein. The side walls 11 have a mating face 111 from which the central slot 13 is recessed and a mounting face 112 for mounting on the mother printed circuit board.

A plurality of contacts 2 are mounted in the housing 1. The contacts 2 are arranged in two rows along the lengthwise direction of the housing 1 and each has a retaining portion 21 to fix with the housing 1, a deflectable contacting arm 22 extending upwardly from the retaining portion 21 and a soldering portion 23 extending downwardly from the retaining portion 21 and projecting beyond the mounting face 112 to be soldered onto the mother printed circuit board. The contacting arm 22 protrudes inwardly into the central slot 13 to contact with golden pads on a pair of opposite lower sides of the module 200. A pair of board locks 3 are mounted onto a bottom side of the housing 1 and extend downwardly and beyond the mounting face 112 to be soldered onto the mother printed circuit board.

Compared to DDR 3 memory module, the number of golden pads on opposite lower edges of the module 200 is increased to expand storage capacity and transmission speed of the module 200. The bottom edge of the module 200 is recessed upwardly with a keying notch 201. A tab 131 is formed in the central slot 13 to divide the central slot 13 into a left portion and a right portion. The tab 131 functions as a key to allow the module 200 with a corresponding keying notch 201 to be inserted into the central slot 13. Left side edge of the module 200 is provided with an upper notch 202 and a lower notch 203 positioned on a lower side of the upper notch 202. The upper notch 202 is U-shaped and alternatively may be a semi-circular cutout. The lower notch 203 is a cam notch being utilized to facilitate and allow for easier insertion of the module 200 and includes a guiding face 204 extending upwardly and obliquely. The lower notch 203 is configured to be a trapezoid.

Figure 3:
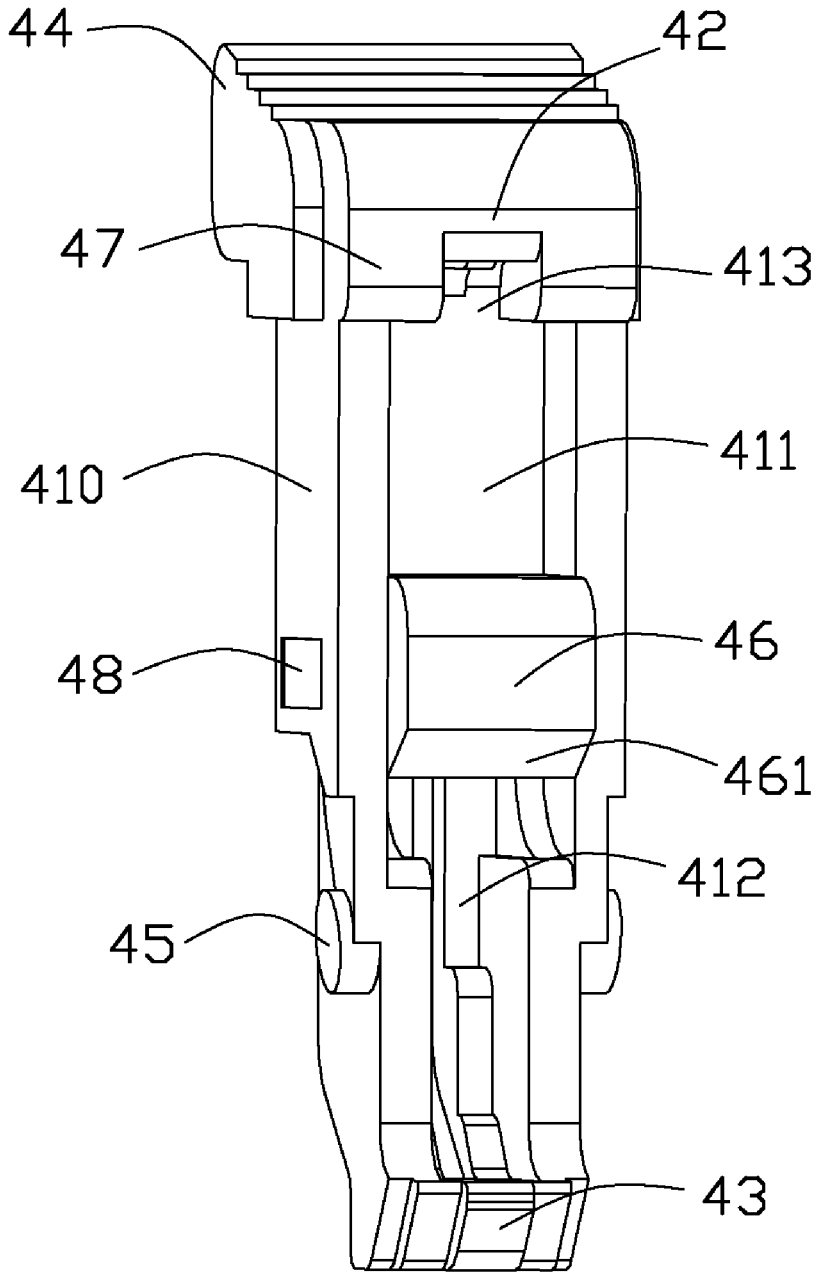
FIG. 3 is a perspective view of an ejector of the card edge connector.
Figure 4:
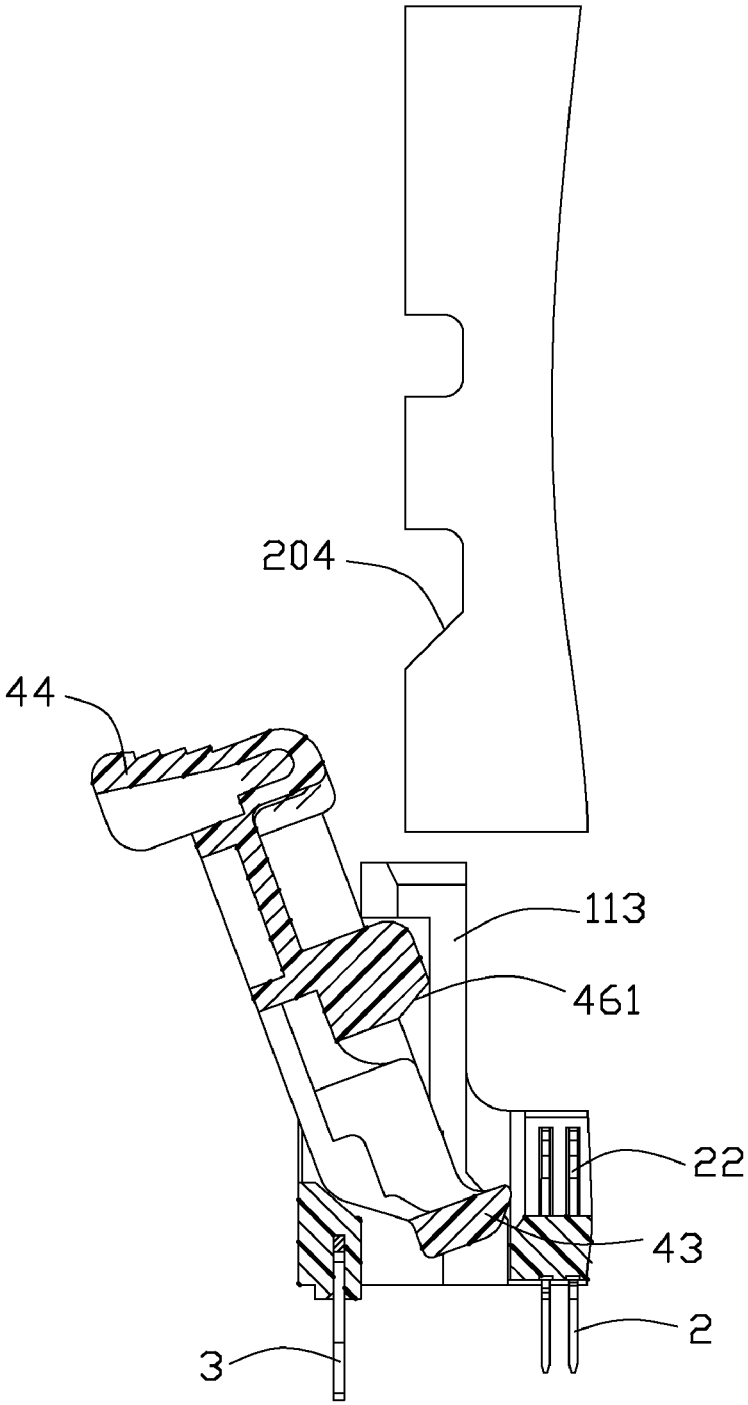
FIG. 4 is a partially sectional view showing the position of the card edge connector and the module before the module is inserted into the card edge connector.

A tower portion 14 extends upwardly from the mating face 111 to be adjacent to the end wall 12. The tower portion 14 defines a receiving room 141 communicating with the central slot 13. A pair of ejectors 4 are rotatably mounted on the tower portion 14 of the housing 1. As shown in FIG. 3, the ejector 4 each includes a base portion 41, a first locking portion 42 extending inwardly from an upper end of the base portion 41 for retaining the module 200, an ejecting portion 43 projecting from a bottom end of the base portion 41, a gripping portion 44 extending outwardly in a direction opposite to the locking portion 42. The ejecting portion 43 extends into the central slot 13 to eject the memory module from the central slot 13. The receiving room 141 is formed with a pair of position slots 143 spaced from each other along a width direction of the housing 1. The base portion 41 of the ejector 4 includes a pair of side plates 410 spaced from each other along the width direction to be fixed by the positioned by the position slots 143 respectively. An U-shaped connecting plate 144 is formed on an upper side of the tower portion 14 and located between the position slots 143. The connecting plate 144 defines a guiding slot 113 to guide insertion of the module 200.

The tower portion 14 defines a pair of shaft holes 142, the base portion 41 of the ejector 4 includes a pair of shafts 45 extending outwardly from two sides thereof to engage with the shaft holes 142 respectively. The ejector 4 includes a cam lobe 46 which is located below the locking portion 42. The cam lobe 46 connects with inner sides of the side plates 410. The ejector 4 defines an upper groove 411 and a lower groove 412 which are located on opposite sides of the cam lobe 46 along a height direction thereof to receive a side edge of the module 200. The locking portion 42, the cam lobe 46 and the ejecting portion 43 are located on an inner side of the shafts 45. A pair of abutting plates 47 extend downwardly from a lower side of the locking portion 42 to bias against opposite side faces of the module 200, a locking slot 413 is formed between the abutting plates 47 to receive a side edge of the module 200. The locking slot 413, the upper groove 411 and the lower groove 412 are used to receive a lateral side edge of the module 200. The base portion 41 is provided with a protrusion 48 to lock with an end plate 145 on the tower portion 14.

Figure 5:
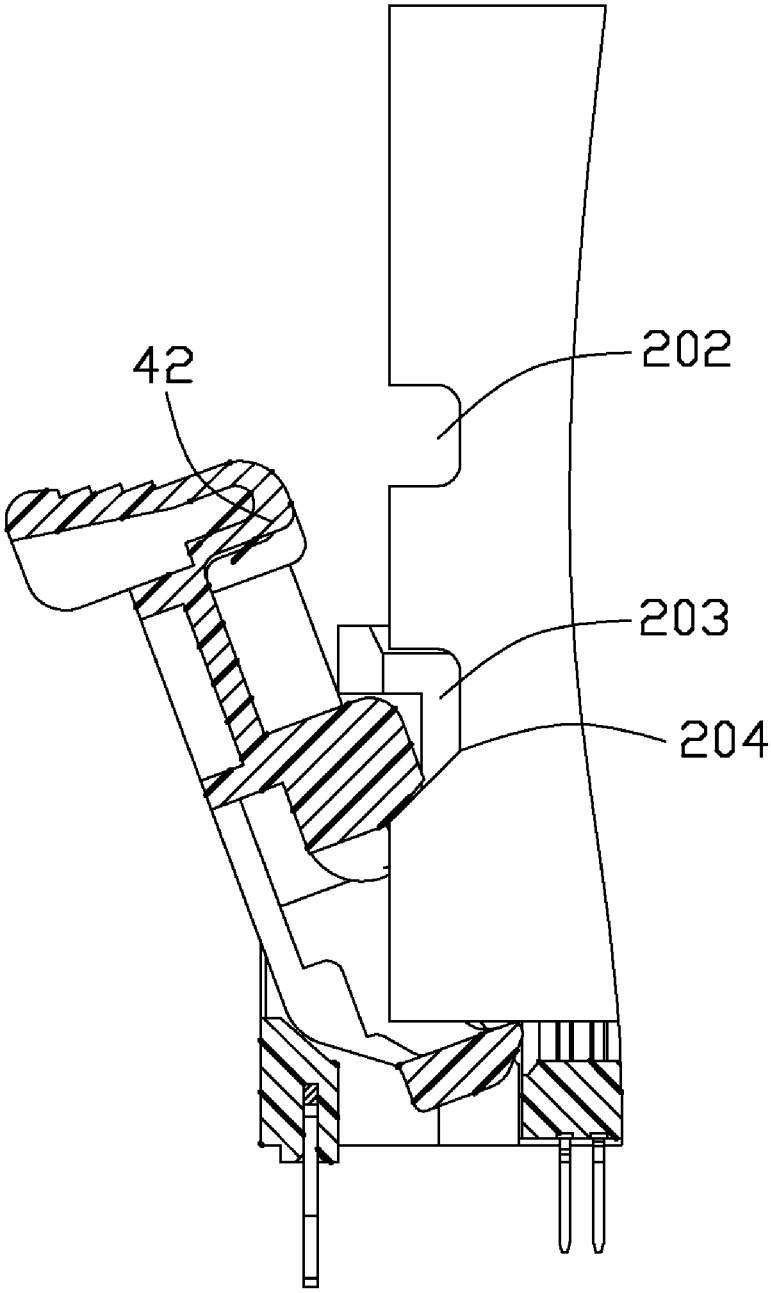
FIG. 5 is a partially sectional view showing the module is partially inserted into the card edge connector.
Figure 6:
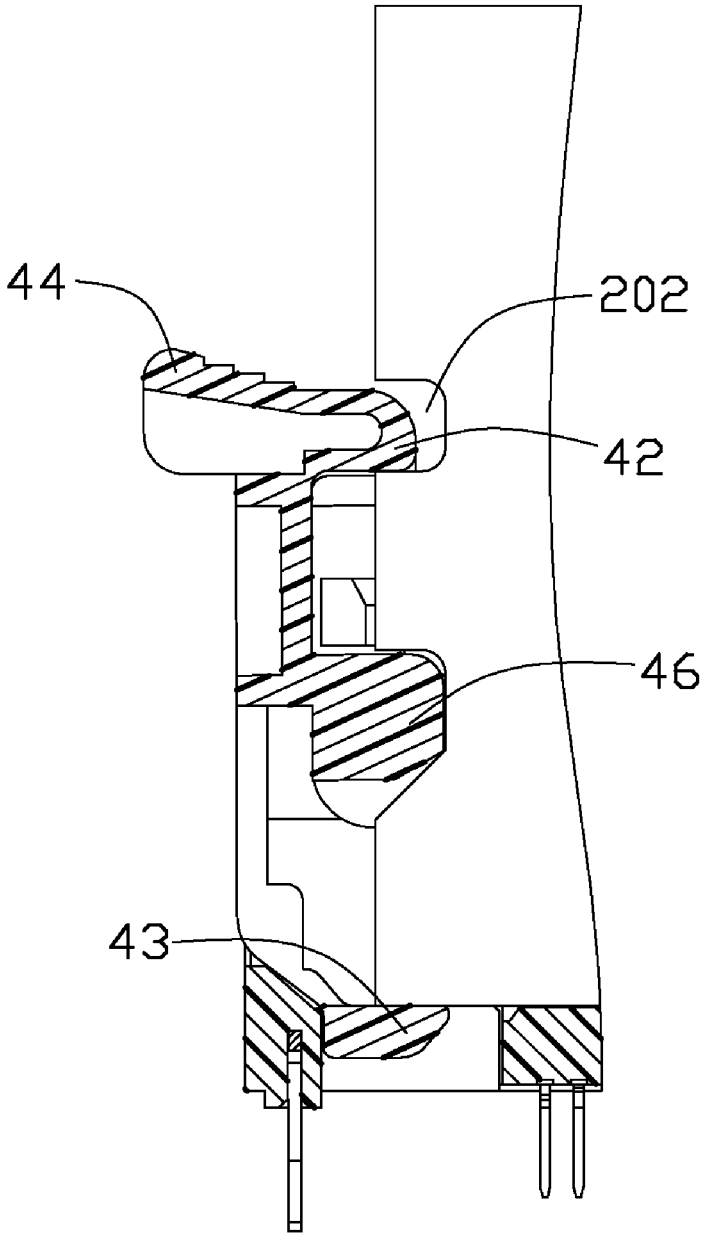
FIG. 6 is a partially sectional view showing the module is completely inserted into the card edge connector.

In an initial state, the ejector 4 is rotated outwardly till the locking portion 42 and the cam lobe 46 are positioned on an outer side of the guiding slot 113 along the lengthwise direction of the housing 1. The cam lobe 46 includes an inclined face 461 extend obliquely and upwardly on a bottom side thereof to bias the module 200 downwardly. An angle formed between the inclined face 461 and the ejecting portion 43 is an acute angle. As shown in FIG. 5, the module 200 is inserted into the guiding slot 113 and partially into the central slot 13, the ejector 4 is rotated inward and an oblique face on a lower side of the lower notch 204 is abutted against by the inclined face 461. In this way, the cam lobe 46 abuts the module 200 to drive the module board down before the module 200 deflects the flexible contacting arm 22 of the contacts 2 outwardly. The cam action allows the use of the ejector 4 as a lever to cam the module 200 down, thereby lowering insertion forces of the module 200. As shown in FIG. 6, the module 200 is fully inserted into the central slot 13, the locking portion 42 of the ejector 4 locks with the upper notch 202 in the module 200 along a height direction of the housing 1 and the cam lobe 46 fixes with the lower notch 203 along the lengthwise direction of the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for receiving a module, comprising:

an insulative housing having a mounting face, a pair of side walls with a central slot formed therebetween, a tower portion extending upwardly from the side wall;

a plurality of contacts mounted to the housing and each defining a retaining portion to fix with the housing, a deflectable contacting arm extending upwardly from the retaining portion and a soldering portion extending downwardly from the retaining portion and projecting beyond the mounting face;

an ejector rotatably mounted on the tower portion of the housing, the ejector including a base portion, an ejecting portion extending inwardly from the base portion and protruding into the central slot to eject the memory module from the central slot and a cam lobe extending inwardly from the base portion to drive the module down, the cam lobe is located above the ejecting portion;

the tower portion defines a pair of shaft holes, the base portion of the ejector includes a pair of shafts extending outwardly from two sides thereof to engage with the shaft holes respectively;

the cam lobe is to abut the module downwardly before the module deflects the deflectable contacting arms mechanically;

the ejector defines a locking portion extending inwardly from the base portion to lock with the module and a gripping portion extending outwardly in a direction opposite to the locking portion, the locking portion is located above the cam lobe;

the locking portion, the cam lobe and the ejecting portion are located on an inner side of the shafts;

the ejector defines a pair of abutting plates on an upper portion thereof to bias against opposite side faces of the module, a locking slot is formed between the abutting plates to receive a side edge of the module.

2. The card edge connector as claimed in claim 1, wherein the cam lobe includes an inclined face extend obliquely and upwardly on a bottom side thereof to bias the module downwardly, an angle formed between the inclined face and the ejecting portion is an acute angle.

3. The card edge connector as claimed in claim 1, wherein; a module including an upper notch and a lower notch on a side edge.

4. The card edge connector as claimed in claim 1, wherein the base portion of the ejector includes a pair of side plates spaced from each other along a width direction of the housing, the cam lobe connects with inner sides of the side plates.

5. The card edge connector as claimed in claim 1, wherein; the ejector comprises a pair of ejectors.

6. The card edge connector as claimed in claim 1, wherein; the upper notch is U-shaped and alternatively may be a semi-circular cutout.

7. The card edge connector as claimed in claim 6, wherein the ejector includes an upper groove and a lower groove which are located on opposite sides of the cam lobe along a height direction thereof.

8. The card edge connector as claimed in claim 6, wherein; the lower notch including a guiding face extending upwardly and obliquely and is configured to be a trapezoid.

9. The card edge connector as claimed in claim 8, wherein; the ejector includes an upper groove and a lower groove which are located on opposite sides of the cam lobe along a height direction thereof.

10. A card edge connector for receiving a module which including an upper notch and a lower notch on a side edge thereof, comprising:

an insulative housing having a mounting face, a pair of side walls with a central slot formed therebetween;

a plurality of contacts mounted to the housing and each defining a retaining portion to fix with the housing, a deflectable contacting arm extending upwardly from the retaining portion and a soldering portion extending downwardly from the retaining portion and projecting beyond the mounting face; an ejector rotatably mounted on the housing, the ejector including a base portion, a locking portion extending inwardly to lock with the upper notch, an ejecting portion extending inwardly from the base portion and protruding into the central slot to eject the memory module from the central slot and a cam lobe extending inwardly from the base portion to firstly drive the module down and finally lock with the lower notch, the cam lobe being located above the ejecting portion;

the cam lobe includes an inclined face extend obliquely and upwardly on a bottom side thereof to bias the module downwardly, an angle formed between the inclined face and the ejecting portion is an acute angle, the lower notch defines an oblique face on a lower side thereof to abut against the inclined face;

the cam lobe is to abut the module downwardly before the module deflects the deflectable contacting arms mechanically, the cam lobe lock with the lower notch along a lengthwise direction of the housing and the locking portion lock with the upper notch along a height direction of the housing under a condition that the module is fully inserted into the central slot;

the tower portion defines a pair of shaft holes, the base portion of the ejector includes a pair of shafts extending outwardly from two sides thereof to engage with the shaft holes respectively.

11. The card edge connector as claimed in claim 10, wherein; a module including an upper notch and a lower notch on a side edge.

12. The card edge connector as claimed in claim 10, wherein; the upper notch is U-shaped and alternatively may be a semi-circular cutout.

13. The card edge connector as claimed in claim 10, wherein the ejector includes an upper groove and a lower groove which are located on opposite sides of the cam lobe along a height direction thereof.

14. The card edge connector as claimed in claim 10, wherein; the lower notch including a guiding face extending upwardly and obliquely and is configured to be a trapezoid.

15. The card edge connector as claimed in claim 14, wherein the ejector defines a gripping portion extending outwardly in a direction opposite to the locking portion, the locking portion, the cam lobe and the ejecting portion are located on an inner side of the shafts, the locking portion is located above the cam lobe.

16. A card edge connector assembly comprising:

an elongated insulative housing defining an elongated slot along a lengthwise direction, and two opposite longitudinal ends along said lengthwise direction;

a plurality of contacts disposed in the housing and by said slot; and an ejector pivotally mounted to one of said longitudinal ends and including a kicker at a bottom portion and a first locker around an upper half portion; wherein said first locker defines an obliquely downward face which is adapted to be received in a first notch of a card type memory module for not only locking the memory module but also guiding insertion of the memory module;

said first notch defines an obliquely upward face in compliance with said obliquely downward face;

said first locker is essentially located around a middle portion of the ejector, and said ejector further includes a second locker at a top portion thereof, said second locker defining a horizontal downward face for downwardly abut against a second notch of the memory module located above said first notch;

the first locker extending toward the elongated slot farther than the second locker in said lengthwise direction.

17. The card edge connector assembly as claimed in claim 16, wherein; a module including an upper notch and a lower notch on a side edge.

18. The card edge connector assembly as claimed in claim 16, wherein; the upper notch is U-shaped and alternatively may be a semi-circular cutout.

19. The card edge connector assembly as claimed in claim 18, wherein; the lower notch including a guiding face extending upwardly and obliquely and is configured to be a trapezoid.

20. The card edge connector assembly as claimed in claim 18, wherein said first locker is larger than said second locker in a vertical direction perpendicular to said lengthwise direction.

* * * * *